US010888485B2

(12) United States Patent
Fleming

(10) Patent No.: US 10,888,485 B2
(45) Date of Patent: Jan. 12, 2021

(54) EXERCISE DEVICE

(71) Applicant: Fleming Elastixx LLC, New York, NY (US)

(72) Inventor: Maureen Fleming, New York, NY (US)

(73) Assignee: Maureen Fleming, New York, NY (US)

( * ) Notice: Subject to any disclaimer, the term of this patent is extended or adjusted under 35 U.S.C. 154(b) by 604 days.

(21) Appl. No.: 15/228,811

(22) Filed: Aug. 4, 2016

(65) Prior Publication Data

US 2017/0036055 A1 Feb. 9, 2017

Related U.S. Application Data

(60) Provisional application No. 62/200,863, filed on Aug. 4, 2015.

(51) Int. Cl.
*A61H 1/02* (2006.01)
*A63B 21/04* (2006.01)
(Continued)

(52) U.S. Cl.
CPC ..... *A61H 1/0255* (2013.01); *A61H 1/0274* (2013.01); *A61H 1/0292* (2013.01);
(Continued)

(58) Field of Classification Search
CPC .. A61H 1/0255; A61H 1/0292; A61H 1/0274; A61H 2201/1635; A61H 2201/018; A61H 2201/1261; A61H 2203/0425; A61H 2201/0123; A61H 2203/0456; A61H 1/0281; A61H 2201/164; A61H 2205/081; A61H 2201/1284; A61H 2201/0119; A61H 1/0277; A61H 2201/0157; A61H 2201/165; A61H 2203/0406; A61H 2209/10; A63B 21/16; A63B 21/4019; A63B 21/0552; A63B 21/4021; A63B 21/4034; A63B 71/023; A63B 21/0557; A63B 21/00069; A63B 65/06; A63B 2208/0204; A63B 21/4035; A63B 2023/006; A63B 21/4015; A63B 23/0405; A63B 23/0238;
(Continued)

(56) References Cited

U.S. PATENT DOCUMENTS 1,432,013 A * 10/1922 Blake ..... A63B 21/0004 482/124
1,566,235 A * 12/1925 Sheehan ..... A61B 17/1327 606/203
(Continued)

*Primary Examiner* — Garrett K Atkinson

(57) ABSTRACT

This application discloses a portable exercise device for flexibility and strengthening. In some embodiments, the device is comprised of one elastic band of surgical tubing or like material and one non-elastic band, with two pairs of looped handles tied to each end of the elastic band. These looped handles can attach to a user's limb without any need for grasping. The non-elastic end of the device can be affixed to an anchor point. The exercise device offers light but adjustable resistance via a resistance modulator, allowing the user to engage in a full range of standing and seated exercises with forces comparable to swimming. In addition, two instances of the device can be combined to engage both the user's hands and feet simultaneously.

7 Claims, 8 Drawing Sheets

(51) Int. Cl.

| | |
|---|---|
| ***A63B 23/035*** | (2006.01) |
| ***A63B 23/18*** | (2006.01) |
| ***A63B 23/12*** | (2006.01) |
| ***A63B 21/00*** | (2006.01) |
| ***A63B 21/16*** | (2006.01) |
| ***A63B 23/02*** | (2006.01) |
| ***A63B 65/06*** | (2006.01) |
| ***A63B 21/055*** | (2006.01) |
| ***A63B 71/02*** | (2006.01) |
| ***A63B 71/00*** | (2006.01) |
| ***A63B 23/04*** | (2006.01) |
| ***A63B 23/00*** | (2006.01) |

(52) U.S. Cl.

CPC ..... *A61H 1/0277* (2013.01); *A61H 1/0281* (2013.01); *A61H 2201/018* (2013.01); *A61H 2201/0119* (2013.01); *A61H 2201/0123* (2013.01); *A61H 2201/0157* (2013.01); *A61H 2201/1261* (2013.01); *A61H 2201/1284* (2013.01); *A61H 2201/164* (2013.01); *A61H 2201/165* (2013.01); *A61H 2201/1635* (2013.01); *A61H 2203/0406* (2013.01); *A61H 2203/0425* (2013.01); *A61H 2203/0456* (2013.01); *A61H 2205/081* (2013.01); *A63B 21/00069* (2013.01); *A63B 21/0442* (2013.01); *A63B 21/0552* (2013.01); *A63B 21/0557* (2013.01); *A63B 21/151* (2013.01); *A63B 21/16* (2013.01); *A63B 21/1663* (2013.01); *A63B 21/4013* (2015.10); *A63B 21/4015* (2015.10); *A63B 21/4019* (2015.10); *A63B 21/4021* (2015.10); *A63B 21/4034* (2015.10); *A63B 21/4035* (2015.10); *A63B 23/0238* (2013.01); *A63B 23/03541* (2013.01); *A63B 23/03575* (2013.01); *A63B 23/0405* (2013.01); *A63B 23/1209* (2013.01); *A63B 23/18* (2013.01); *A63B 65/06* (2013.01); *A63B 71/023* (2013.01); *A63B 2023/006* (2013.01); *A63B 2071/009* (2013.01); *A63B 2208/0204* (2013.01); *A63B 2208/0228* (2013.01); *A63B 2208/0252* (2013.01); *A63B 2209/10* (2013.01)

(58) Field of Classification Search

CPC ..... A63B 21/4013; A63B 23/03541; A63B 21/1663; A63B 2208/0228; A63B 21/151; A63B 23/1209; A63B 23/18; A63B 23/03575; A63B 21/0442; A63B 2209/10; A63B 2071/009; A63B 2208/0252

See application file for complete search history.

(56) References Cited

U.S. PATENT DOCUMENTS

| | | | | | |
|---|---|---|---|---|---|
| 1,638,003 | A | | 8/1927 | Bruno | |
| 2,224,103 | A | * | 12/1940 | Nilson | A63B 21/0004 482/124 |
| 2,408,160 | A | | 9/1946 | Brunner | |
| 2,919,135 | A | | 12/1959 | Marchionda | |
| 3,031,192 | A | | 4/1962 | Edward | |
| 3,069,161 | A | | 12/1962 | Melchiona | |
| 3,157,962 | A | | 11/1964 | Bonnelly | |
| 3,807,730 | A | | 4/1974 | Dalton et al. | |
| 4,019,734 | A | * | 4/1977 | Lee | A63B 21/0552 482/125 |
| 4,057,246 | A | * | 11/1977 | Wilson | A63B 21/0552 482/125 |
| 4,090,705 | A | | 5/1978 | Young | |
| 4,090,706 | A | * | 5/1978 | Reda | A63B 21/0004 482/122 |
| 4,251,071 | A | | 2/1981 | Norton | |
| 4,540,173 | A | * | 9/1985 | Hopkins, Jr. | A63B 21/0552 482/124 |
| 4,685,671 | A | * | 8/1987 | Hagerman | A63B 21/04 482/124 |
| 4,733,862 | A | * | 3/1988 | Miller | A63B 21/0552 24/129 R |
| 4,762,318 | A | * | 8/1988 | Phillips | A63B 21/0004 24/115 L |
| 4,784,386 | A | | 11/1988 | Muehl | |
| 4,852,874 | A | * | 8/1989 | Sleichter, III | A63B 21/0004 482/122 |
| 4,911,439 | A | * | 3/1990 | Kuhl | A63B 21/0552 482/124 |
| 5,090,691 | A | * | 2/1992 | Pollock | A63B 21/151 16/426 |
| 5,199,940 | A | * | 4/1993 | Morris | A61F 5/055 128/845 |
| 5,318,494 | A | * | 6/1994 | Santighian | A63B 21/0004 482/121 |
| D353,172 | S | * | 12/1994 | Gaut | D21/692 |
| 5,514,058 | A | | 5/1996 | Buoni et al. | |
| 5,514,059 | A | * | 5/1996 | Romney | A63B 21/0004 482/121 |
| 5,681,248 | A | * | 10/1997 | Vani | A63B 21/0004 482/10 |
| 5,813,954 | A | * | 9/1998 | Wilkinson | A63B 21/0004 482/124 |
| 5,851,167 | A | * | 12/1998 | Li | A63B 21/0004 482/122 |
| 5,860,896 | A | * | 1/1999 | Mann | A61F 5/026 482/121 |
| 5,961,406 | A | | 10/1999 | Hass | |
| 6,244,998 | B1 | * | 6/2001 | Hinds | A63B 21/0004 482/124 |
| 6,308,956 | B1 | | 10/2001 | Reid | |
| 6,450,929 | B1 | * | 9/2002 | Markham | A63B 21/0552 482/121 |
| 6,659,921 | B2 | * | 12/2003 | Vernon | A63B 21/0442 482/114 |
| 6,672,997 | B1 | * | 1/2004 | Winkler | A63B 21/0552 482/121 |
| 6,837,836 | B2 | | 1/2005 | Huang | |
| 7,175,574 | B2 | * | 2/2007 | Carmel | A63B 21/0004 482/124 |
| 7,662,073 | B1 | * | 2/2010 | Baldwin | A63B 21/4021 482/139 |
| 7,775,949 | B2 | * | 8/2010 | Bowser | A63B 21/00043 482/121 |
| 7,931,572 | B1 | * | 4/2011 | Glauser | A63B 21/0004 482/126 |
| 7,998,034 | B1 | * | 8/2011 | Cobo | A63B 69/0028 482/126 |
| 8,012,071 | B2 | * | 9/2011 | Grisdale | A63B 21/0004 482/122 |
| 8,613,690 | B1 | | 12/2013 | Thompson | |
| 9,592,418 | B2 | * | 3/2017 | Burrell | A63B 21/4007 |
| 9,630,081 | B2 | * | 4/2017 | Gillespie | A63B 21/00043 |
| 9,962,575 | B2 | * | 5/2018 | Askins | A63B 23/025 |
| 10,112,072 | B2 | * | 10/2018 | Burrell | A63B 21/00043 |
| 10,406,396 | B2 | * | 9/2019 | Hauptmann | A63B 21/00043 |
| 2002/0187884 | A1 | * | 12/2002 | McGrath | A63B 21/0552 482/121 |
| 2004/0038784 | A1 | | 2/2004 | Huang | |
| 2004/0152569 | A1 | * | 8/2004 | Lerner | A63B 21/0552 482/124 |
| 2004/0180767 | A1 | * | 9/2004 | Carmel | A63B 21/0004 482/126 |
| 2006/0063652 | A1 | * | 3/2006 | Berman | A63B 21/0004 482/139 |
| 2006/0094573 | A1 | | 5/2006 | Weck | |
| 2007/0099780 | A1 | * | 5/2007 | Bowser | A63B 21/00043 482/148 |
| 2008/0108486 | A1 | * | 5/2008 | Vigilia | A63B 21/0004 482/124 |
| 2012/0302412 | A1 | | 11/2012 | Nail | |

(56) References Cited

U.S. PATENT DOCUMENTS

| | | | | |
|---|---|---|---|---|
| 2013/0143724 | A1 | 6/2013 | Demeo | |
| 2013/0165301 | A1* | 6/2013 | Thrasher-Rudd | A63B 7/00 482/129 |
| 2014/0179499 | A1 | 6/2014 | Weber et al. | |
| 2014/0371039 | A1* | 12/2014 | Burrell | A63B 21/0555 482/124 |
| 2017/0182357 | A1* | 6/2017 | Burrell | A61F 5/026 |

* cited by examiner

EXERCISE DEVICE

CROSS-REFERENCE

This application claims the benefit of U.S. Provisional Application No. 62/200,863, filed Aug. 4, 2015, which application is incorporated herein by reference.

TECHNICAL FIELD

The present invention is related to exercise devices, and more specifically, to such devices with portable, adjustable bands.

BACKGROUND

Existing exercise devices using elastic bands are primarily designed for strength or resistance training. Such devices tend to focus on exercising the upper-body or other isolated parts of the body utilizing elastics with high resistance. In addition, such devices typically include various types of handles that the user grasp carefully in order to perform the exercises. Therefore, these devices do not harness the potential of elastic bands to engage muscles simultaneously in full-body and full-motion flexibility and strengthening exercise routines.

SUMMARY OF THE INVENTION

This application discloses a portable elastic exercise device consisting of one or more bands, with multiple loop handles at each end of the elastic bands. In some embodiments, these looped handles are attached to the device by a connector comprising a mechanism that holds the bases of the handles together and an outer wrap for further security and protection. The handle loops can wrap around a user's hands or feet, allowing the user to engage in stretching exercises without grabbing onto the device itself. Through a resistance modulator that easily moves, tightens, and loosens, user can adjust the level of resistance provided by the bands as necessary for intended exercises, stretches, and movements. A user can combine several of these elastic devices to simultaneously attach both hands and feet, permitting the user to perform a wide range of full-body stretching exercises and movements. The bands attach to a high anchor point or any other fixed point.

The device disclosed in this application has a number of useful features. The device is lightweight, portable, and attaches easily to common structures, such as door frames, ceiling beams, or trees. The construction of the device supports a wide range of distortions. The light resistance of the material generally used to form the body of the device can withstand stretching to lengths nearly double its relaxed state. This stretching quality is conducive to stretching and flexibility exercises, as opposed to only strength-training exercises, which require heavier resistance. The light resistance of the material furthermore promotes a free range of motion comparable to the feeling of swimming and allows the user to engage in a wider range of movements than naturally possible (see FIG. 6). The device's resistance modulator does, however, permit the user to adjust the effective resistance of the device, allowing the user to tailor the resistance of the bands to expand or restrict the user's movements as desired. An additional benefit of the resistance modulator is its easy adjustability. By simply loosening and fastening the resistance modulator, the user can quickly form or reform a fixation point anywhere within a portion of the device, which is much easier than making and later untying a knot along the elastic bands, for example.

The outer covering at the bases of the looped handles guards the connector against unraveling during tight twisting maneuvers. The covering also further secures the loops comprising each handle in place, which maintains the structural integrity of the looped handles. These looped handles allow the user to attach the device to her body without the need for grasping the device itself. By freeing the user from gripping the device, the device can engage the user's innermost muscles, rather than the outer muscles necessary for grasping. Furthermore, because the device does not require gripping, the user's limbs can remain free to perform other functions simultaneously, whether for other motions, for balance, or for incorporating other exercise objects. Specifically, the user may employ the present device along with other exercise accessories, such as medicine balls or exercise rollers, for a richer and more substantial exercise routine. For example, the user may attach the bands to his or her feet and sit on exercise accessories to raise her pelvis, thereby expanding possible poses for seated exercises. The looped handles are also easy to grasp, should the user desire to engage each finger or perform gripping exercises.

The exercise device can target specific muscles, such as the psoas muscle. A relaxed and released psoas stabilizes the spine and provides support through the trunk. However, a tight psoas constricts the organs, puts pressure on nerves, interferes with the movement of fluids, and impairs diaphragmatic breathing. The exercise device aids in both lengthening and opening the psoas muscle, by facilitating a gentle pull on the limbs that allows the space between the vertebrae to expand through engagement of the small muscles connecting them. It also allows the user to easily gauge whether the psoas muscle is being properly stretched through vocal sounds, often during movements that depict certain images, as the psoas muscle is connected to the diaphragm, which are both important components of vocalization. While engaging the exercise device, the user can effortlessly produce vocal sounds, which vary as the psoas muscle changes, and can adjust the engagement of the exercise device accordingly.

INCORPORATION BY REFERENCE

All publications, patents, and patent applications mentioned in this specification are herein incorporated by reference to the same extent as if each individual publication, patent, or patent application was specifically and individually indicated to be incorporated by reference.

BRIEF DESCRIPTION OF THE DRAWINGS

The novel features of the invention are set forth with particularity in the appended claims. A better understanding of the features and advantages of the present invention will be obtained by reference to the following detailed description that sets forth illustrative embodiments, in which the principles of the invention are utilized, and the accompanying drawings of which:

DETAILED DESCRIPTION

Figure 1:
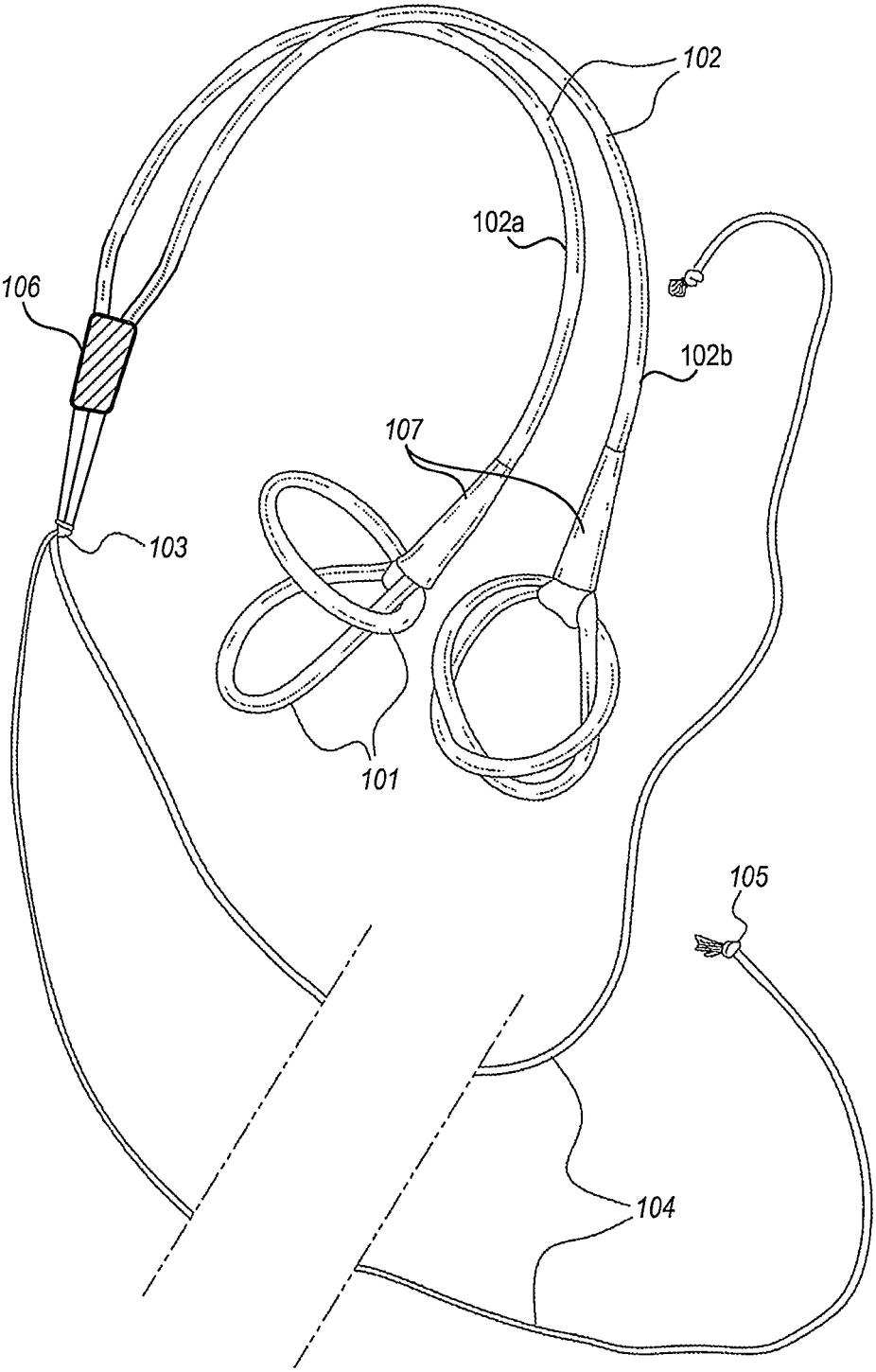
FIG. 1 illustrates an example device disclosed in the present application in its resting state.

FIG. 1 illustrates an example device disclosed in the present application in its resting state. In some embodiments, the exercise device includes a pair of the bands 102 and 104, which are tied together at the juncture 103. The elastic band 102 is formed from surgical tubing (typically made of latex rubber) or other material with similar elastic characteristics. A preferred length for the band 102 is between 52 inches and 92 inches, although the actual length can be any desired value. A preferred girth of the band 102 is between 1.5 and 2 inches though the user may choose tubing of different thickness as needed (with wider tubing generally providing greater resistance). The juncture 103 divides the band 102 into two halves 102*a* and 102*b*, each attaching to a looped handle 101 at the other end. The looped handle 101, which includes two or more loops, can wrap around a hand or a foot of the user or may be gripped by a hand of the user. The looped handle 101 can be formed from the same surgical tubing as the band 102, or other material with similar elastic characteristics as surgical tubing. In other embodiments, the handle has a webbed structure that allows a hand or a foot to be threaded around and thus securely engaged without having to grab onto the device. The covering 107, which can be made of adhesive silicone or similar protective material that offers a permanent air-tight, water-tight seal, wraps around the base of the handle 101 and reinforces its attachment to the band 102.

In some embodiments, the band 104 is formed from non-elastic rope, such as braided polyester or cotton with a synthetic core, or other rope of non-elastic material. A preferred length for the band 104 is 26 inches to 46 inches, although the actual length can be any desired value. The preferred girth of the band 104 is 0.75 inches though the thickness may vary depending on how or where the device is to be fixated. Each end of the band 104 is processed to avoid breakage, such as by creating a knot 105. If desired, the resistance modulator 106 rests around the band 102. It should be appreciated by someone of ordinary skill in the art that the device can include more than two bands, some of which can be bundled together to be applied to the same limb or otherwise used for the same purpose.

Figure 2:
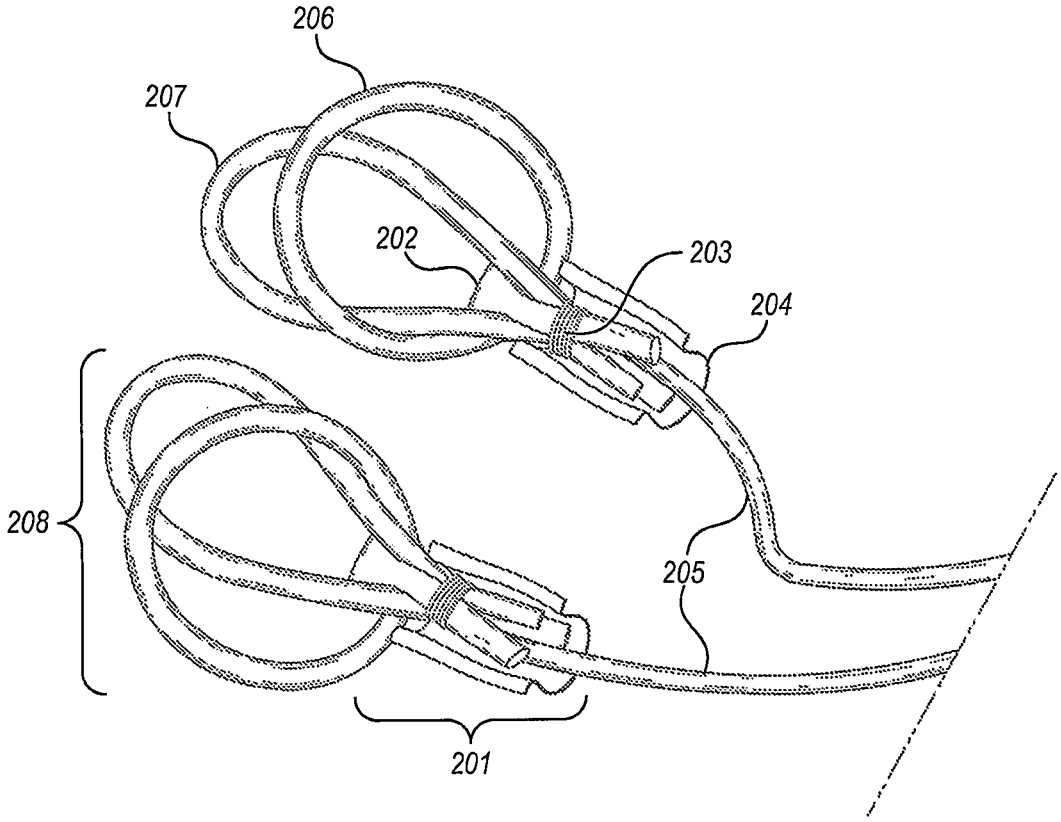
FIG. 2 illustrates an example looped handle.

FIG. 2 illustrates an example looped handle. In some embodiments, the looped handle 208 comprises five pieces: the band 205, the ring 206, the segment 202, the tie 203, and the covering 204. The band 205 is the same piece as the band 102 described in FIG. 1. One end of each of the band 205 is folded back to form a single loop 207. The ring 206 is an unbroken elastic ring of the same or similar material as the band 205, preferably 12 to 14 inches in circumference, which can be juxtaposed with the loop 207 to form dual loops. It should be appreciated by someone of ordinary skill in the art that the device may contain multiple such loops. The segment 202 is piece of the same or similar tubing as the band 205 with a preferred length of 6- to 8-inches, threaded around the loop 207 and the ring 206. The tie 203, consisting of wax thread or similar binding material with a preferred length of 48 to 60 inches, wraps around the bundle of cords formed from folding back both the band 205 and the segment 202, and holds the band 205, the ring 206, and the segment 202 in place. The covering 204 (also the covering 107 described in FIG. 1), which can be formed from an adhesive silicone material or other similar material, wraps around the base of the looped handles as tightly as possible, covering both ends of the segment 202, the folded-back end of the band 205, and the binding tie 203. Together, these components comprise the connector 201.

Each looped handle can be made of fewer components. In one embodiment, the band 205 is folded back on itself multiple times to form multiple loops. The base of these folds is bound together by the tie 203 and wrapped by the covering 204. In another embodiment, a separate elastic tubing segment is folded multiple times to create multiple loops. These loops are bound to each end of the band 205 by the tie 203 and wrapped by the covering 204.

Figure 3:
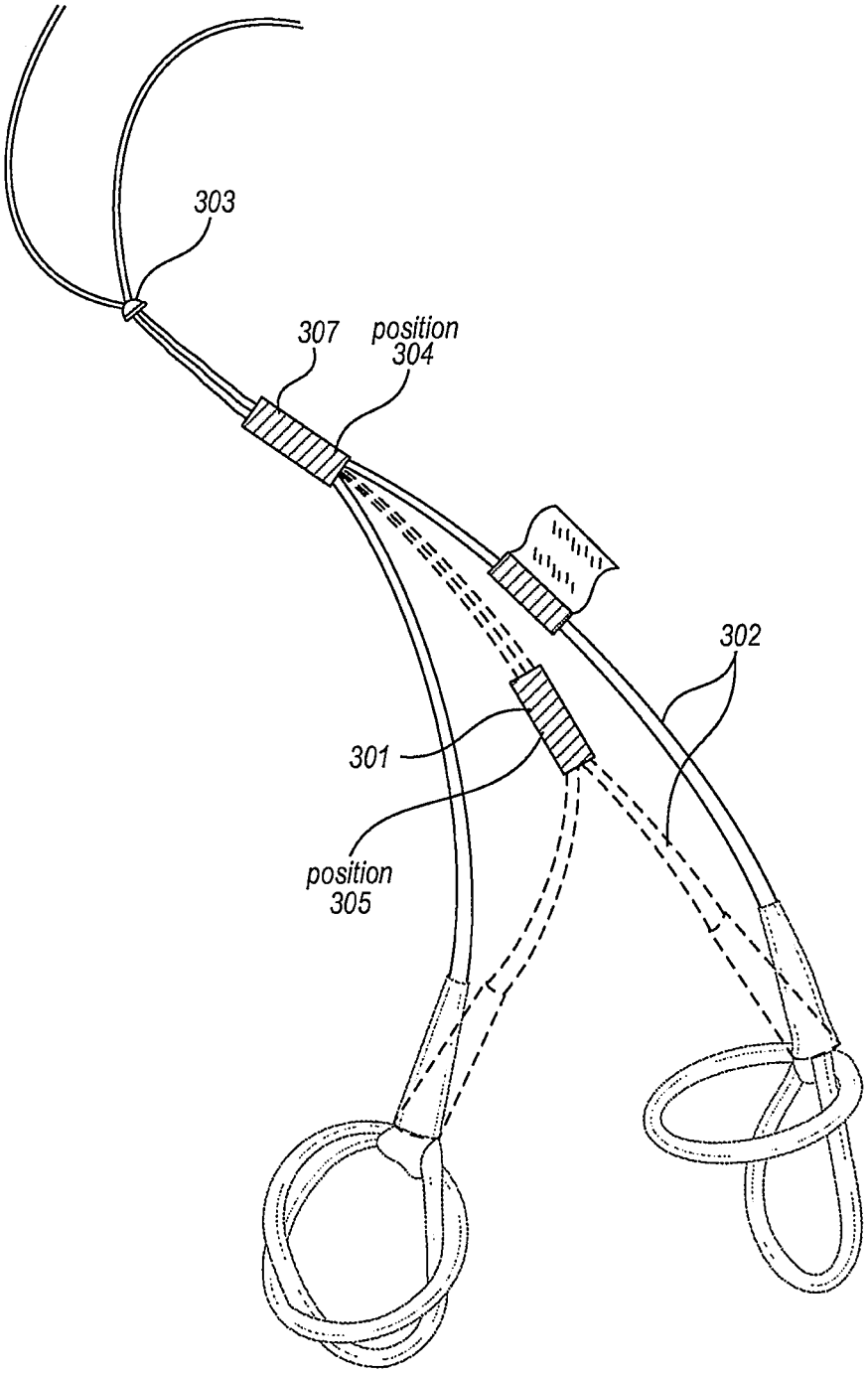
FIG. 3 illustrates an example resistance modulator.

FIG. 3 illustrates an example resistance modulator. In some embodiments, the resistance modulator 301 at the position 306 includes a strap of made of nylon, polyester, rubber, or other material with a hook and loop fastener, which enables fast tightening and loosening. The strap has a preferred length of 4 to 6 inches and a preferred width of 0.75 to 1.25 inches. In one embodiment, one end of the strap forms a closed loop around one segment of the band 302, while the other end of the strap remains free. It should be appreciated by someone of ordinary skill in the art that the strap can also be removable from the device. The diameter of the loop is to be slightly wider than the diameter of the segment, such as quarter an inch wider, so that it can be moved up and down the segment. A user can then wrap the other end of the strap around both segments of the band 302 as tightly as possible and ultimately fasten the strap to form a significant damper on the band 302 at that position, such as the position 305. While the fastening does not completely cut off the elasticity of the band 302, it has a similar effect as breaking the band 302 at that position. Therefore, the position of the strap determines an effective length of the elastic portion from the handle and thus the resistance felt by the user. The user can then loosen the strap, slide it to another position, and fasten it again to obtain a desired level of resistance. The farther away the user places the resistance modulator to the juncture 303, the shorter the elastic portion between the handle and the strap, the less flexibility, and thus the greater the resistance afforded to the user. Therefore, for example, position 305 provides more resistance than does position 304. In general, the user can disengage the resistance modulator by leaving the non-looped end free, thereby keeping both segments of the band 302 detached from one another and maintaining the full range of motion and minimum resistance of the band 302, while keeping the resistance modulator attached to the device for ease of access.

In another embodiment, the resistance modulator 307 can be completely standalone, with neither end wrapping around any portion of the band 302 in the loosened state. The user can keep the resistance modulator 307 attached to the device by securing the strap of the modulator around one segment of the band 302. The user can then move the resistance modulator along that segment, detach the two ends from each other, and fasten them around both segments of the band 302. Alternatively, the user can adjust the resistance modulator by unfastening the strap of the modulator, removing it from the exercise device (rather than sliding it along the bands), and securing it at the desired location on both segments of the band 302.

Figure 4:
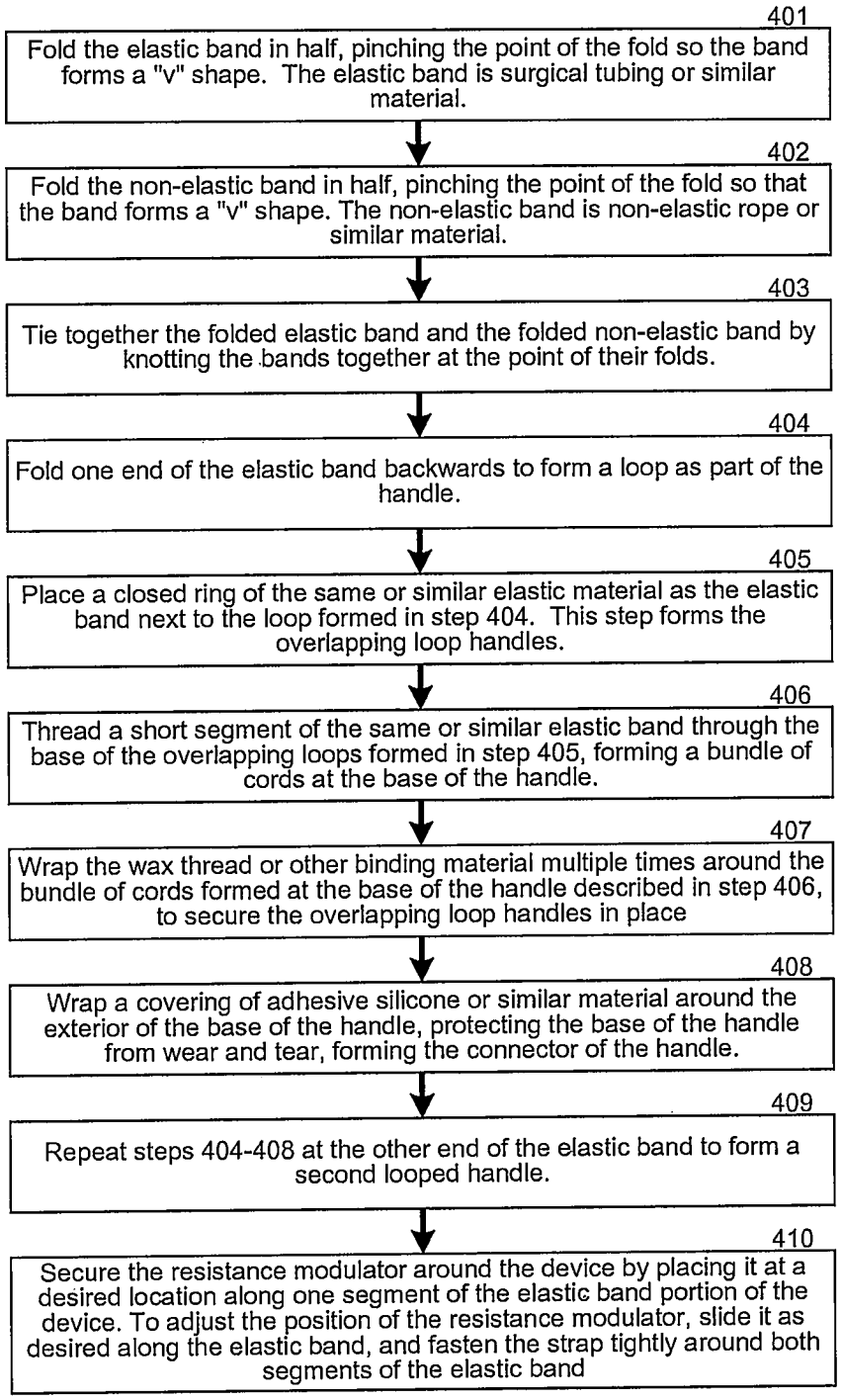
FIG. 4 illustrates an example process of assembling the device.

FIG. 4 illustrates an example process of assembling the device. In step 401, the user forms the two elastic segments of the exercise device by folding approximately in half an elastic band approximately 26 to 46 inches in length. In step 402, the user forms the two non-elastic segments used to affix the device by folding a non-elastic band approximately in half. In step 403, the user attaches the elastic and non-elastic bands together by tying them together, ideally around their mid-points. There are many ways to attach the elastic and non-elastic bands to each other, for example by tying the elastic and non-elastic bands together using various knotting techniques, or using a separate thread to join the bands. In step 404, the user begins the formation of one looped handle by folding one end of the elastic band backwards to form a loop. In another embodiment, the user folds this end of the elastic band over multiple times to form multiple loops (as described above in FIG. 2).

In step 405, the user forms the dual loop of the handle by placing a closed ring of the same of similar material as the elastic band next to the loop formed by folding back the elastic band in step 404. In another embodiment, the closed elastic ring is superfluous—for example, when the elastic band itself forms multiple loops, as previously described. In step 406, the user threads a short segment of the same or similar elastic tubing through the loop formed in step 404 and the closed ring of step 405, to secure both loops in place. This step forms the bundle of cords that comprises the base of the looped handle. In another embodiment, this short elastic segment is also superfluous, as there is no separate piece (i.e., a closed elastic ring) to secure to the multiple loops formed by the elastic band itself, folded multiple times. In step 407, the user wraps a wax thread or similar binding material around the bundle of cords gathered at the base of the looped handle, as formed in step 406. In another embodiment, the user wraps the binding thread around the base of multiple loops formed by folding back the end of the elastic band multiple times to secure those loops in place.

In step 408, the user protects the base and structural integrity of the looped handle by wrapping a protective covering, made from adhesive silicone or similar material, around the exterior of the base as tightly as possible, forming the connector of the handle. In step 409, the user repeats steps 404-408 to form the second looped handle attached to the other end of the elastic band. In step 410, the user attaches the resistance modulator by wrapping the hook and loop strap around one or both segments of the elastic band at a desired location. The strap secures in place around the exterior of the elastic band by wrapping around and adhering to itself via its hook and loop fastening properties. In another embodiment, the user can forgo step 410 if no resistance modulator is desired and leave the resistance of the device unadjusted.

Figure 5:
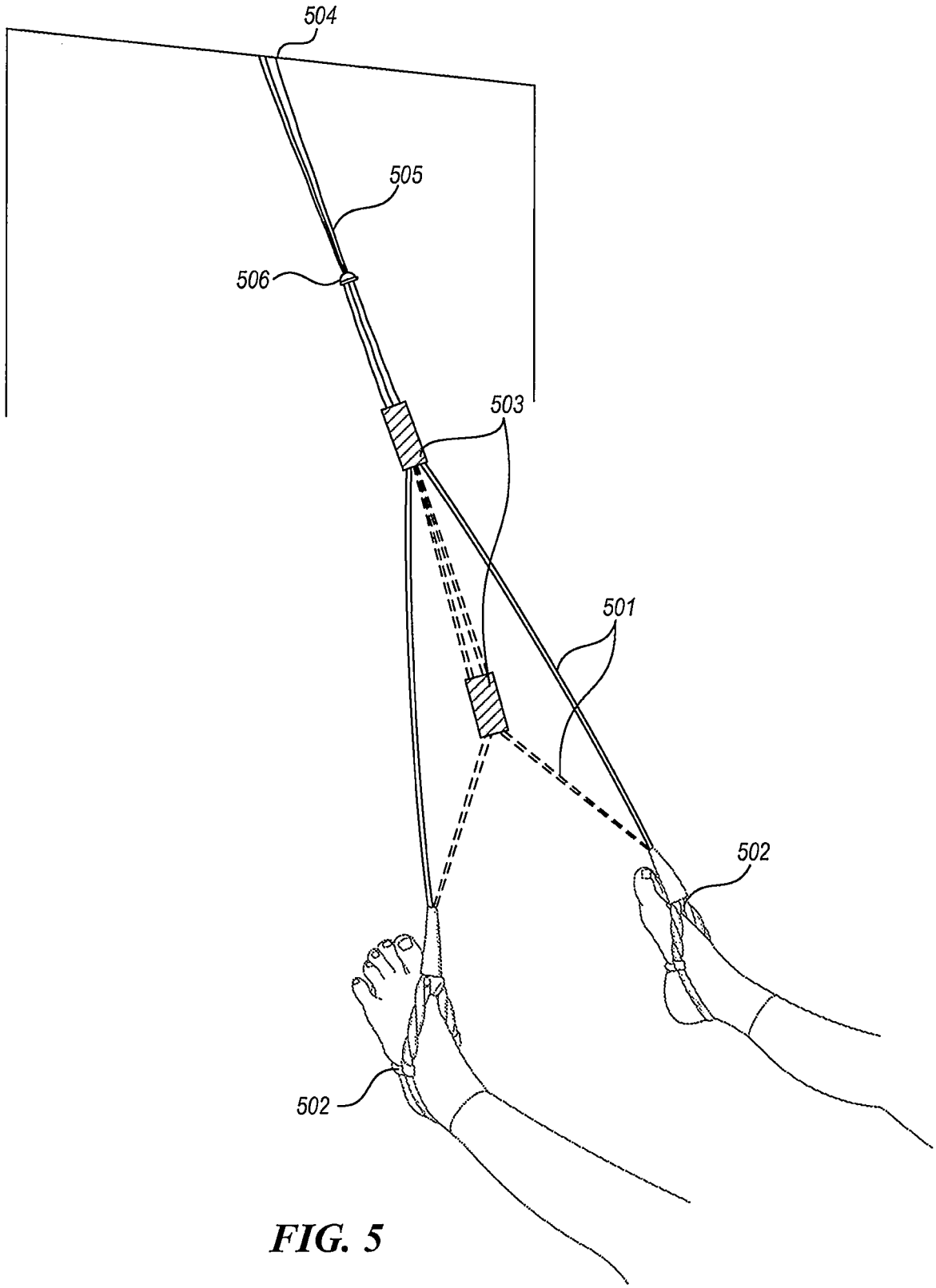
FIG. 5 illustrates an example application of the device to a user's legs during horizontal or vertical exercises.

FIG. 5 illustrates an example application of the device to a user's legs during horizontal or vertical exercises. In this embodiment, the non-elastic band 505 is affixed to a high attachment point 504 and the two looped handles 502 wrap around the user's feet and ankles. One way to attach the looped handles to the user's feet is to intertwine the looped handles and slip the user's heel between one of the slots created by the intertwined loops of the handle directly opposite the base of the handle, as shown in FIG. 5, while the user's foot points through both intertwined loops and toward the base of the handle. In another embodiment, the user can add additional bands attaching to the same limbs, which is another mechanism for increasing resistance. The resistance of the bands 501 adjusts with the placement of the resistance modulator 503. As the user slides the resistance modulator 503 down the bands 501 away from the juncture 506, the resistance will increase. It should be appreciated by someone of ordinary skill in the art that the resistance modulator 503 can rest in a fastened or unfastened position around just one segment of the band 501, or around one or both segments of the band 505, or be entirely removed from the exercise device, should the user wish not to engage the resistance modulator.

Figure 6:
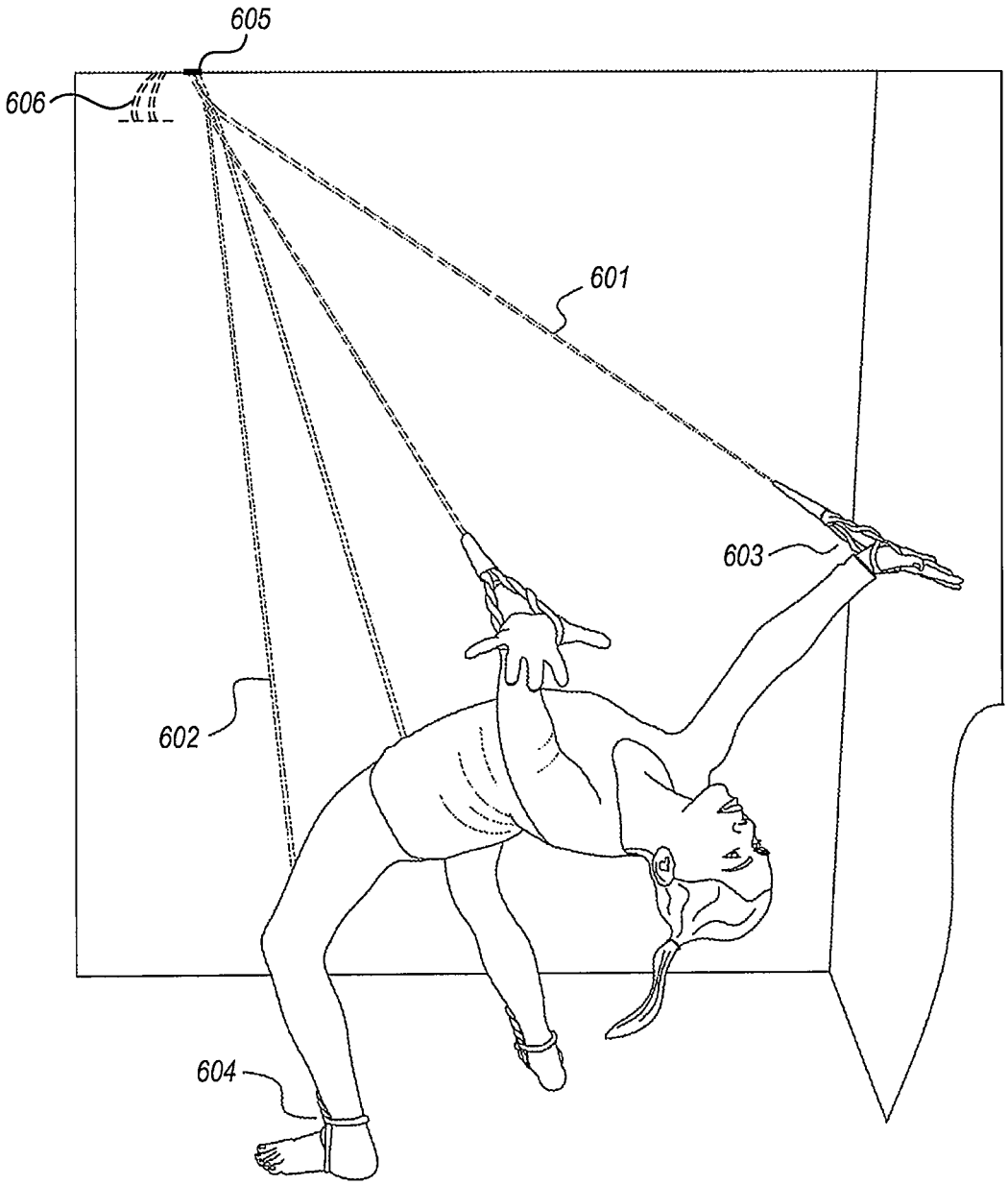
FIG. 6 illustrates an example application of the device, where two such devices are combined to engage the user's hands and feet simultaneously in a standing exercise.

FIG. 6 illustrates an example application of the device, where two such devices are combined to engage the user's hands and feet simultaneously in a standing exercise. The devices 601 and 602 are separately affixed to a high attachment point 605, or alternatively, are tied to each other and attached together to an attachment point. In this embodiment, the attachment point 605 is created by draping the non-elastic bands 606 of the device across the top of a door and shutting the door, thereby affixing the device between the top of the door and the door frame. The non-elastic bands can also be attached around a beam or other secure points after, for example, tying the ends of the non-elastic bands together using a double loop slipknot reinforced tightly with additional tie. The looped handles 603 are wrapped around the users hands. One way to attach the looped handles to the user's hand is to intertwine the looped handles and slip the user's fingers between one of the slots created by the intertwined loops of the handle directly opposite the base of the handle, while inserting the thumb into an adjacent slot created by the intertwined loops, as depicted in FIG. 6. The looped handles 604 are wrapped around the user's feet.

In some embodiments, the user can slip one or more fingers into one or more of the slots and leave the other fingers free. The user can also wrap the multiple looped handles around the hands, wrists, feet, ankles, elbows, or knees in various ways, as the elasticity and number of the multiple looped handle enables numerous possibilities for creating gentle traction for the joints both at suspended rest or during exercise. This includes interlacing the fingers while the looped handles are attached to the wrists, with the user's hands supporting the back of the head, which can create a gentle therapeutic traction and elongation of the connective tissue of the neck vertebra. As shown by the illustration, the combination of a pair of these exercise devices provides the appropriate amount of resistance to allow the user to stretch into backwards-bending positions not otherwise possible without the support of light-resistance bands. It should be appreciated by someone of ordinary skill in the art that the user can also employ the device to stretch the limbs backwards and in other directions, while the user is facing away from the attachment point of one or multiple exercise devices or otherwise not directly facing the exercise device itself.

Figure 7:
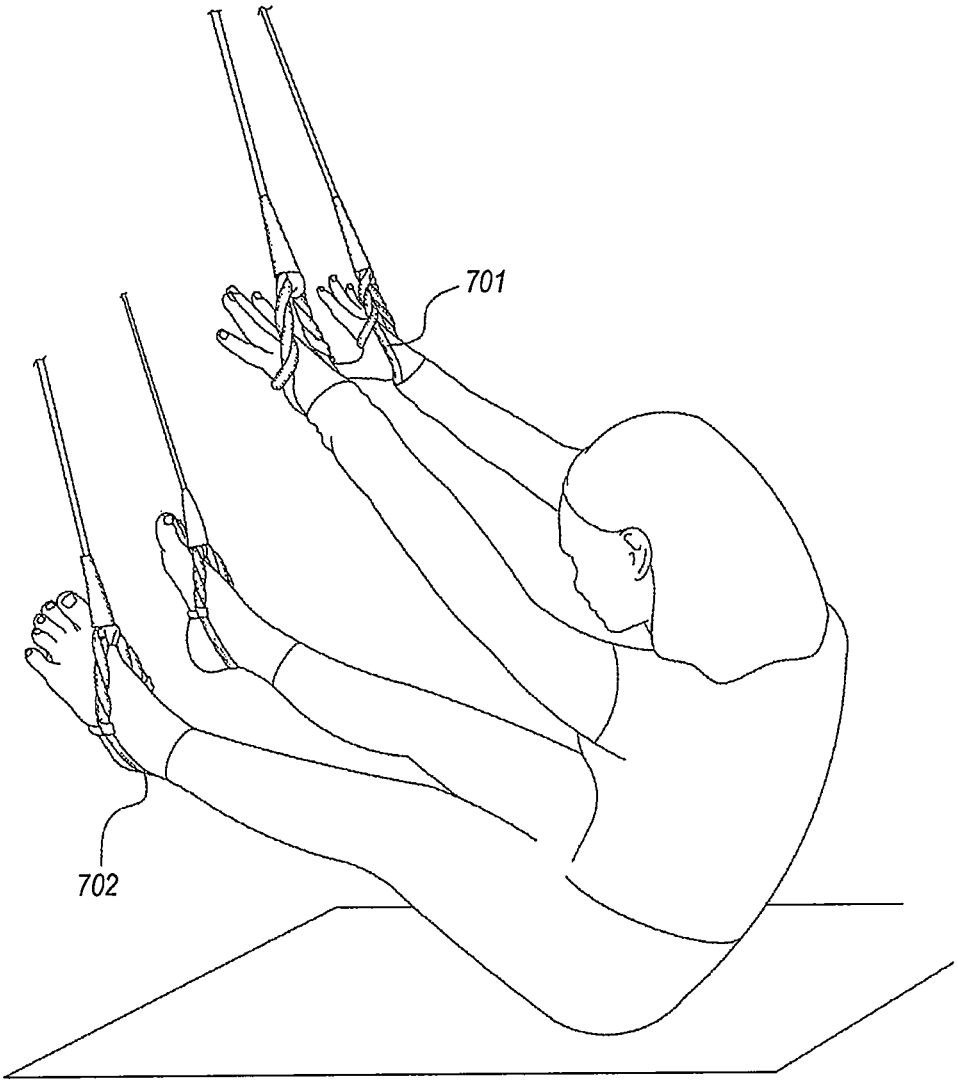
FIG. 7 illustrates another example application of the device, where two such devices are combined to engage the user's hands and feet simultaneously in a seated exercise.

FIG. 7 illustrates another example application of the device, where two such devices are combined to engage the user's hands and feet simultaneously in a seated exercise. Similar to the application illustrated in FIG. 6, the two devices can be separately affixed to a high attachment point. Here, the looped handles 701 wrap around the user's hands. The looped handles 702 wrap around the user's feet. While seated, the user may suspend and stretch her limbs by relying on the resistance of the bands. It should be appreciated that the pose illustrated in this figure can be intermediate in a full routine where the body transitions through different positions, such as standing up, rolling down to the floor, and returning to the standing position. It should also be appreciated by someone of ordinary skill in the art that with hands and/or feet engaged, the user may involve additional exercise devices such as an exercise ball or roller, padded stool or chair, through the chest, the back, or other portions of the body, while lying down, standing, or seated at various heights.

In some embodiments, the exercise device can cause the psoas muscle to open and lengthen with the aid of vocalization. A body configuration where a user sits on a surface, such as the floor or an exercise roller, while the limbs are suspended by the bands, as illustrated in FIG. 7, is conducive to stretching the psoas muscle and producing resonant vocal sounds. In this position, the user's tailbone area is in contact with the floor or other surface while the lower back is suspended off of the floor or other surface and the limbs are gently pulled. The exercise band, which maintains a buoyant quality similar to the psoas muscle, allows the lengthening of joints and connective tissue, and thus, the psoas muscle is free to expand in all directions. Therefore, the gentle pulling of the exercise band creates a pathway for the psoas muscle to lengthen in opposition to this gentle pull, without constriction. This pulling can take place as the user moves from a vertical to a horizontal position and returns or gently rocks as each vertebra comes into contact with the ground or other surface, for example.

In some embodiments, while operating the exercise device, the user can continuously produce vocalizations as an indication of how the psoas muscle is being engaged. The psoas muscle and the diaphragm are positioned in such a way that through gently pulling the limbs and releasing the psoas muscle, the exercise device ultimately pulls the diaphragm downwards and opens other muscles between the ribs. When this gentle pulling and opening of the diaphragm occurs, the user can achieve a desired breathing balance, which permits a vibrating sensation in the upper palate of the mouth and a distinct resonant sound. Therefore, by listening to the change of the vocal sounds, the user can continuously adjust the operation of the exercise device until he or she hears the resonant sound, which indicates that the psoas muscle is being properly engaged. For example, the user can adjust the position of the pelvis in relation to the pulling of the exercise device or recalibrate the resistance level of the exercise device, to achieve the desired resonant sound. Since the psoas is the only muscle to connect the spine to the legs, the user can also combine the stretching of the arms by the band 701 with simple movements, such as bicycle kicking of the legs, to enhance the production of vocal sound and strengthen the psoas muscle.

Figure 8:
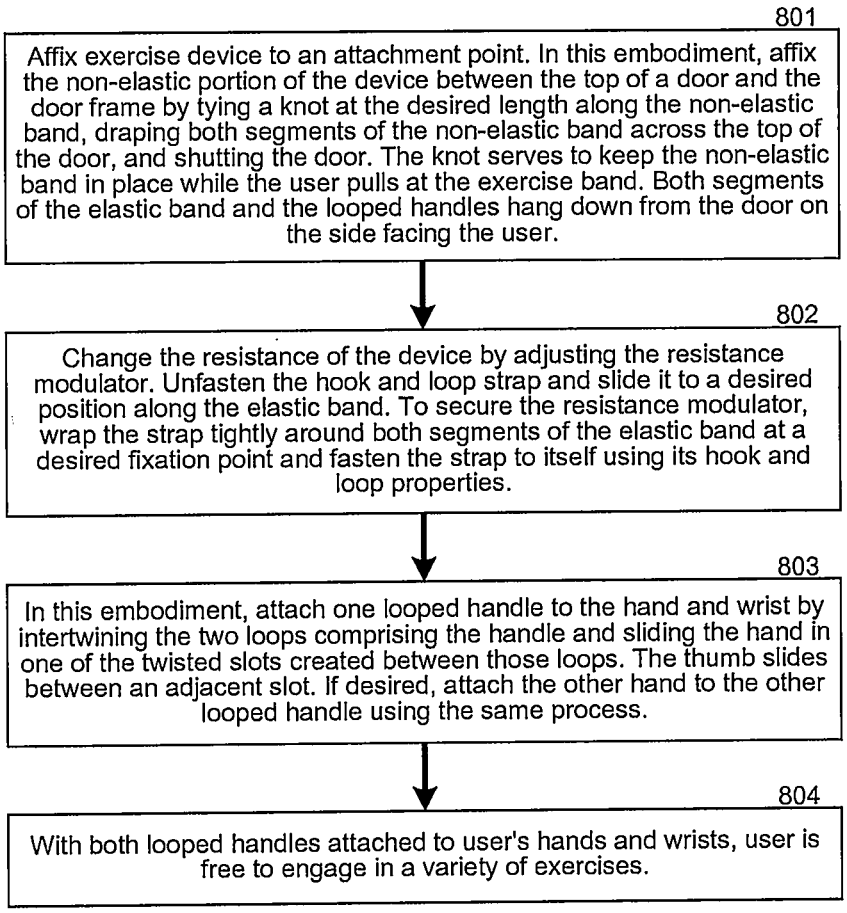
FIG. 8 illustrates an example process by which a user would employ the device in one of its embodiments.

FIG. 8 illustrates an example process by which a user would employ the device in one of its embodiments. In step 801, the user attaches the device to a stationary point. The point of attachment can be the top of a doorway. Alternatively, the device can be strung across a ceiling beam or a lower point of attachment as desired. The device can also be affixed by tying the non-elastic portion of the device to the attachment point. In step 802, the user prepares the device for the desired exercises by adjusting the resistance of the elastic bands via the resistance modulator. In one embodiment, the resistance modulator rests on the device by being fastened to just one segment of the elastic band. To engage the resistance modulator, the user unfastens the strap of the modulator and slides the strap to the desired fixation point along the elastic bands, which allows the user to control the level of resistance. Once the strap is at the desired location, the user secures it in place by tightly wrapping the strap around both segments of the elastic band and around itself, adhering by way of its hook and loop fastening properties. In another embodiment, the user adjusts the resistance modulator by unfastening the strap, removing it from the device, and replacing it at the desired fixation point, rather than sliding the strap along the various bands of the device. In another embodiment, the user who desires no resistance adjustment can remove the resistance modulator entirely, or secure the strap around just one segment of the elastic band or around one or both segments of the non-elastic bands.

In step 803, the user begins to engage the device by pulling the looped handles away from the attachment point and toward the user. The user then attaches both looped handles to her hands and wrists without the need to grasp the handles themselves. It should be appreciated by someone of ordinary skill in the art that there are multiple ways the user can engage the looped handles. In one embodiment, the user intertwines the multiple loops of each handle, forming multiple slots in which the user can insert fingers, palm, or wrist, to attach the handle without the need for gripping. The twisting slots created by intertwining the multiple loops of the handle act to secure the hand in place without the user gripping the handle. In another embodiment, the user attaches just one looped handle and grasps the other; or the user grasps both looped handles; or the user attaches or grasps one looped handle and keeps the other hand free to engage in other actions. In another embodiment, the user attaches one or both looped handles around the ankles and feet. In another embodiment, the user combines multiple devices in the same exercise—with two devices, for example, the user attaches the looped handles to each hand and each foot for a full-body exercise. In step 804, the user is ready to perform a variety of stretching, strengthening, and flexibility exercises as desired.

CONCLUSION

In addition to the above mentioned examples, various other modifications and alterations of the invention may be made without departing from the invention. Accordingly, the above disclosure is not to be considered as limiting, and the appended claims are to be interpreted as encompassing the true spirit and the entire scope of the invention.

Although various features of the invention may be described in the context of a single embodiment, the features may also be provided separately or in any suitable combination. Conversely, although the invention may be described herein in the context of separate embodiments for clarity, the invention may also be implemented in a single embodiment.

Reference in the specification to "some embodiments", "an embodiment", "one embodiment" or "other embodiments" means that a particular feature, structure, or characteristic described in connection with the embodiments is included in at least some embodiments, but not necessarily all embodiments, of the inventions.

It is to be understood that the phraseology and terminology employed herein is not to be construed as limiting and are for descriptive purpose only.

It is to be understood that the details set forth herein do not construe a limitation to an application of the invention.

Furthermore, it is to be understood that the invention can be carried out or practiced in various ways and that the invention can be implemented in embodiments other than the ones outlined in the description above.

It is to be understood that the terms "including", "comprising", "consisting" and grammatical variants thereof do not preclude the addition of one or more components, features, steps, or integers or groups thereof and that the terms are to be construed as specifying components, features, steps or integers.

What is claimed is:

1. An exercise device, comprising a plurality of elastic and tubular stretching portions; a plurality of elastic and tubular handle portions, an inelastic fixation portion configured to be secured above a user; and a modulator, wherein the plurality of stretching portions is connected to the fixation portion, wherein the plurality of handle portions are respectively connected to the plurality of stretching portions, wherein each stretching portion is connected to one of the handle portions at a connection point, the exercise device further comprising a covering at each connection point that covers the connection point and secures the plurality of tubular and elastic looped handles in place, maintaining the structural integrity of the elasticity of the plurality of looped handles and stretching portions, wherein the plurality of elastic and tubular handle portions are structured to fit one or more parts of the upper and lower limbs of a user at the same time, wherein when the modulator is in a relaxed configuration, the user can slide the modulator vertically along at least one of the plurality of stretching portions, and wherein when the modulator is in a tightened configuration, the modulator ties together the plurality of stretching portions, to adjust the resistance provided to the user when the user pulls against the plurality of stretching portions.

2. The exercise device of claim 1, wherein the covering is made of wrapped silicone.

3. The exercise device of claim 1, wherein each handle portion includes a plurality of elastic and tubular loops.

4. The exercise device of claim 3, wherein each of the plurality of elastic loops is both circular and tubular.

5. The exercise device of claim 1, wherein each handle portion includes two looped structures that can be twisted together to fit around each other to securely engage one or more parts of the upper or lower limb of the user, and configured to retain the user's extremities, wherein the elastic and tubular handle portions can be configured to secure one or more parts of the upper or lower limbs of the user, without the user gripping, the handle portions.

6. The exercise device of claim 1, wherein for each of the plurality of stretching portions, a distance between the modulator and the fixation portion connected to the stretching portion adjusts the resistance provided to the user when the user pulls against the plurality of stretching portions, wherein the user can add additional stretching portions to adjust the resistance provided to the user.

7. The exercise device of claim 1, wherein the modulator is made of nylon and includes a hook and loop fastener that the user can slide vertically along a single stretching portion of the device and fasten tightly around the plurality of stretching portions to adjust the resistance provided to the user.

* * * * *